US008007138B2

(12) United States Patent
Bamba et al.

(10) Patent No.: US 8,007,138 B2
(45) Date of Patent: Aug. 30, 2011

(54) LIGHTING DEVICE

(75) Inventors: Shoichi Bamba, Tokyo (JP); Yosuke Mizuki, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 278 days.

(21) Appl. No.: 12/352,581

(22) Filed: Jan. 12, 2009

(65) Prior Publication Data

US 2009/0180286 A1 Jul. 16, 2009

(30) Foreign Application Priority Data

Jan. 11, 2008 (JP) ..... 2008-003877

(51) Int. Cl.
*F21V 5/02* (2006.01)
*F21V 3/02* (2006.01)

(52) U.S. Cl. ..... 362/309; 362/329; 362/311.06; 362/339

(58) Field of Classification Search ..... 362/311.06, 362/297, 309, 329, 339, 337, 522, 346, 327, 362/328, 307, 308, 310, 298, 299, 300, 301
See application file for complete search history.

(56) References Cited

U.S. PATENT DOCUMENTS 3,226,537 A * 12/1965 Hanson et al. ..... 362/540
3,858,039 A * 12/1974 Moore ..... 362/285
5,577,493 A * 11/1996 Parkyn et al. ..... 126/699
6,431,738 B1 * 8/2002 Kondo et al. ..... 362/517
7,077,542 B2 * 7/2006 Lee et al. ..... 362/224
7,766,515 B2 * 8/2010 Condon et al. ..... 362/311.06
2008/0130309 A1 * 6/2008 Condon et al. ..... 362/520

FOREIGN PATENT DOCUMENTS

JP 60130001 7/1985

* cited by examiner

*Primary Examiner* — Bao Q Truong
(74) *Attorney, Agent, or Firm* — Kenealy Vaidya LLP

(57) ABSTRACT

A lighting device can be configured to prevent light beams emitted from a light source from passing through an outer peripheral surface of a lens and from being projected outside of the illumination direction of the lighting device. In the lighting device, the light source can be disposed within a lighting chamber defined by a substrate and the lens. The lens can have a lens cut portion on the rear surface thereof. A reflection surface can be formed in the outer peripheral surface of the lens. The substrate can also have a reflecting portion configured to project light beams reflected by the outer peripheral surface of the lens in the illumination direction. The reflecting portion can be disposed on the front side of the substrate. Light beams emitted from the light source at a certain angle with respect to the main optical axis of the light source cannot be reflected by the lens cut portion but can be reflected by the front surface of the lens toward the outer peripheral surface of the lens to be allowed to pass therethrough.

22 Claims, 6 Drawing Sheets

LIGHTING DEVICE

This application claims the priority benefit under 35 U.S.C. §119 of Japanese Patent Application No. 2008-003877 filed on Jan. 11, 2008, which is hereby incorporated in its entirety by reference.

BACKGROUND

1. Technical Field

The presently disclosed subject matter relates to lighting devices, and in particular, to lighting devices which include a substrate provided with a light source and a lens with a lens cut portion formed on a rear surface thereof, the lens cut portion being configured to control the illumination direction of the device.

2. Description of the Related Art

Known conventional lighting devices have a substrate, a lens (lens portion), and a light source (for example, an LED chip) disposed inside a lighting chamber (for example, a space) defined by the substrate and the lens (see, for example, Japanese Patent Application Laid-Open No. Sho 60-130001). This type of lighting device is shown in FIGS. 1A and 1B. As shown, the lighting device has a lens portion 50 which includes a lens cut portion 70 formed on a rear surface of the lens portion 50. The light includes light beams emitted from the light source 20 at a certain angle with respect to the main optical axis and which can be incident on the lens cut portion 70. Then, the light is reflected by the lens cut portion 70 to be projected in the illumination direction of the lighting device (upward in the drawing).

In this lighting device, light beams emitted from the light source 20 at a relatively small angle with respect to the main optical axis of the light source 20 can be incident on and be refracted by the lens cut portion 70 so as to be projected in the illumination direction of the lighting device. Light beams emitted from the light source 20 at a relatively large angle with respect to the main optical axis can be incident on the lens cut portion 70, but also reflected by the same so as to be projected in the illumination direction.

In the above configuration of the lighting device, when the lens 50 is formed of a resin material, corners of the lens cut portion 70 may not be able to take an acute shape due to some molding condition restrictions (for example, draft angle of a molding die or the like). In this case, the corners thereof may take a rounded shape (with a corner R).

As a result, when light beams are emitted from the light source at an angle of about 45° or the like with respect to the main optical axis of the light source, part of the light beams may not be refracted or reflected by the lens cut portion 70, but may be reflected by the front surface of the lens 50 to be directed to, and transmit through, the outer peripheral surface (side face 50*a*) of the lens 50. In this case, the light beams may be projected outside of the designated projection area. This may lower the light utilization efficiency. In addition, the projected light beams may become glare light.

SUMMARY

The presently disclosed subject matter was devised in view of these and other features, problems, and characteristics in association with the conventional art. According to an aspect of the presently disclosed subject matter, a lighting device can prevent at least some of light beams emitted from a light source at a certain angle with respect to the main optical axis of the light source from being projected out of the projection area when the light beams are not reflected by a lens cut portion, but are reflected by the front surface of the lens and pass through an outer periphery of the lens.

According to another aspect of the presently disclosed subject matter, a lighting device can include a substrate; a lens disposed to be opposed to the substrate, the lens having an outer peripheral surface and being provided with a first lens cut portion formed on a rear surface of the lens with respect to an illumination direction of the lighting device, the substrate and the lens defining a lighting chamber therebetween; a light source disposed inside the lighting chamber and having a main optical axis substantially aligned with the illumination direction, the light source configured to emit light beams at certain angles with respect to the main optical axis, some of the light beams being reflected by the first lens cut portion to be projected in the illumination direction; a reflection surface configured to reflect light beams that are emitted from the light source at a certain angle with respect to the main optical axis, reflected inside the lens, and enter the outer peripheral surface of the lens, the reflection surface being provided on or near the outer peripheral surface of the lens; and a reflecting portion configured to reflect the light beams reflected from the reflection surface to be projected in the illumination direction, the reflecting portion being disposed on a front side of the substrate with respect to the illumination direction.

In the lighting device configured as above, the reflection surface can be formed by subjecting the outer peripheral surface of the lens to a reflection treatment such as a brightness treatment.

The lens can be provided with a transmission area between the first lens cut portion and the outer peripheral surface of the lens, the transmission area being configured to allow light beams that are reflected by the reflecting portion to pass therethrough so as to be projected in the illumination direction.

In the lighting device configured as described above, the lens can be provided with a second lens cut portion in the transmission area, and the second lens cut portion can control the light distribution property of light beams passing through the transmission area.

In the lighting device configured as above, the substrate can be formed of a reflective material so that the reflecting portion can be integrated with the substrate.

In the lighting device configured according to the presently disclosed subject matter, the light source can be disposed within the lighting chamber defined by the substrate and the lens. The first lens cut portion can be formed on the rear surface of the lens with respect to the main optical axis. In the above configuration, some of the light beams emitted from the light source at a certain angle with respect to the main optical axis of the light source can be reflected by the first lens cut portion so as to be projected in the illumination direction of the lighting device.

On the other hand, when light beams are emitted from the light source at a certain angle with respect to the main optical axis of the light source, some of the light beams cannot be refracted or reflected by the first lens cut portion, but instead may be reflected by the front surface (rear side of the front surface) of the lens to be directed to, and transmit through, the outer peripheral surface (side face) of the lens. In this case, the light beams may be projected out of the projection area in the illumination direction of the lighting device without being effectively utilized. Furthermore, the light beams projected through the outer peripheral surface may become glare light. On the contrary, in an embodiment of a lighting device made in accordance with principles of the presently disclosed subject matter, a reflection surface can be configured to reflect those light beams and can be provided at the outer peripheral surface of the lens. The reflection surface can be formed by subjecting the lens outer periphery to a reflection treatment such as a brightness treatment.

Furthermore, the reflecting portion can be provided on a front surface of the substrate in order to direct the light beams reflected from the reflection surface provided at the outer peripheral surface of the lens towards the illumination direction for projection.

Specifically, when light beams are emitted from the light source at a certain angle with respect to the main optical axis of the light source, some of the light beams that cannot be refracted or reflected by the first lens cut portion, but are reflected by the front surface of the lens can be reflected by the reflection surface of the outer peripheral surface of the lens that includes the reflection surface. Then, the light beams can be reflected by the reflecting portion disposed on the front surface of the substrate to be projected in the illumination direction of the lighting device.

According to the above configuration, the lighting device can prevent at least some of the light beams emitted from a light source which are directed at a certain angle with respect to the main optical axis of the light source from being projected out of a projection area in the illumination direction of the lighting device when the light beams are not reflected by the first lens cut portion, but are instead reflected by the front surface of the lens and then pass through an outer periphery of the lens.

In another embodiment of a lighting device of the presently disclosed subject matter, the transmission area can be provided between the first lens cut portion and the outer peripheral surface of the lens in order to allow the light beams reflected by the reflecting portion to pass therethrough so as to be projected in the illumination direction.

In other words, light beams that are emitted from the light source at a certain range of angles with respect to the main optical axis of the light source and that are reflected not by the first lens cut portion but by the front surface of the lens can be reflected by the reflection surface of the outer peripheral surface of the lens. Then, the light beams can be reflected by the reflecting portion disposed on the front side of the substrate, and subsequently can pass through the transmission area disposed between the first lens cut portion and the outer peripheral surface of the lens to be projected in the illumination direction of the lighting device.

Accordingly, the lighting device as configured above can control the light beams reflected from the reflecting portion so as not to allow them to pass through the first lens cut portion that can reflect light beams from the light source, but to allow them to pass through the transmission area disposed between the first lens cut portion and the outer peripheral surface of the lens.

This lighting device can prevent the reflected light beams from the reflecting portion from being projected outside of the projection area in the illumination direction of the lighting device. Otherwise, the light beams pass through the first lens cut portion to be projected out of the projection area.

In the lighting device with the above configuration, the second lens cut portion can be formed in the transmission area in order to control the light distribution property of light passing through the transmission area. In this instance, the reflected light from the reflecting portion does not simply pass through the transmission area, but passes through the second lens cut portion in the transmission area and is controlled in terms of light distribution property. Accordingly, the lighting device can form a different light distribution pattern as compared with the case where the reflected light from the reflecting portion simply passes through the transmission area.

When the substrate is formed of a reflective material so that the reflecting portion is integrated with the substrate, the parts cost and the assembly cost as a whole can be suppressed as compared with the case where the substrate and the reflecting portion are provided separately.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Figure 1A:
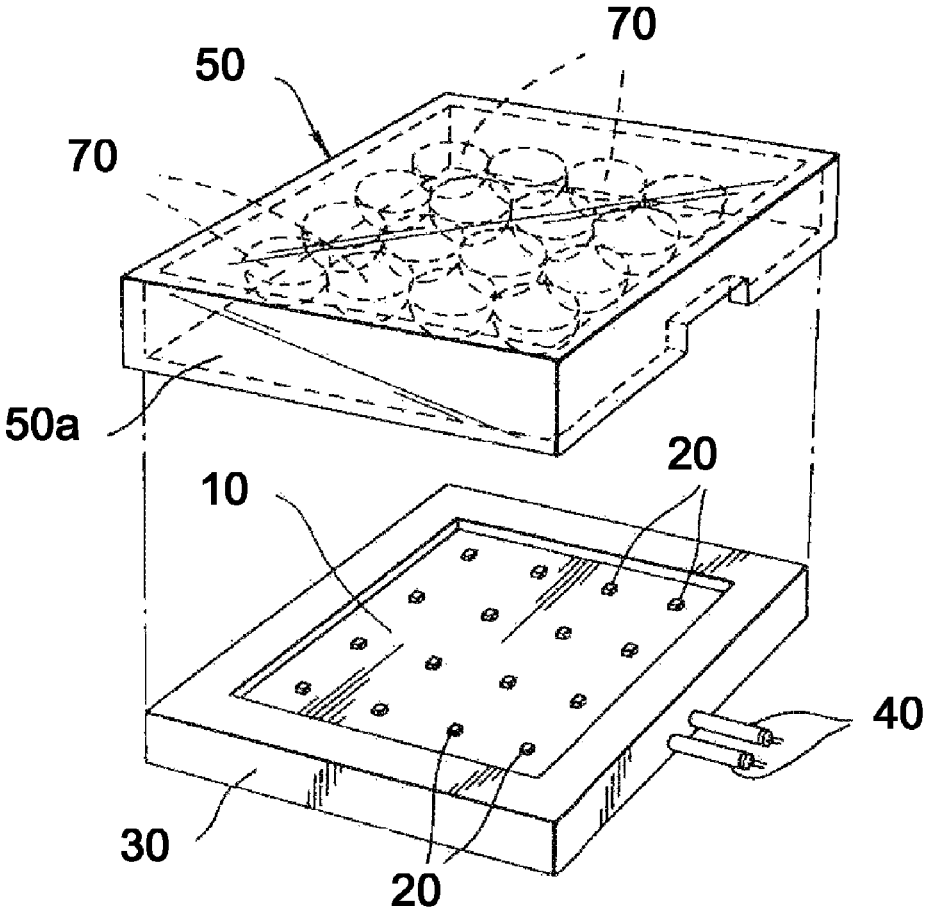
Fig. 1A Conventional Art
FIG. 1A is a perspective view of a conventional lighting device in a disassembled state.
Figure 1B:
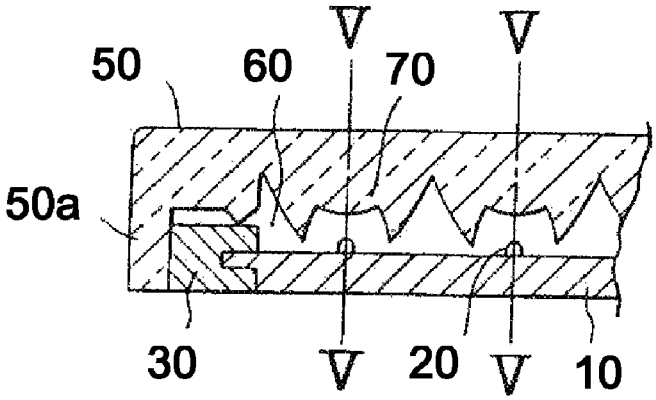
Fig. 1B Conventional Art
FIG. 1B is a cross-sectional view illustrating part of the conventional lighting device of FIG. 1A.
Figure 2A:
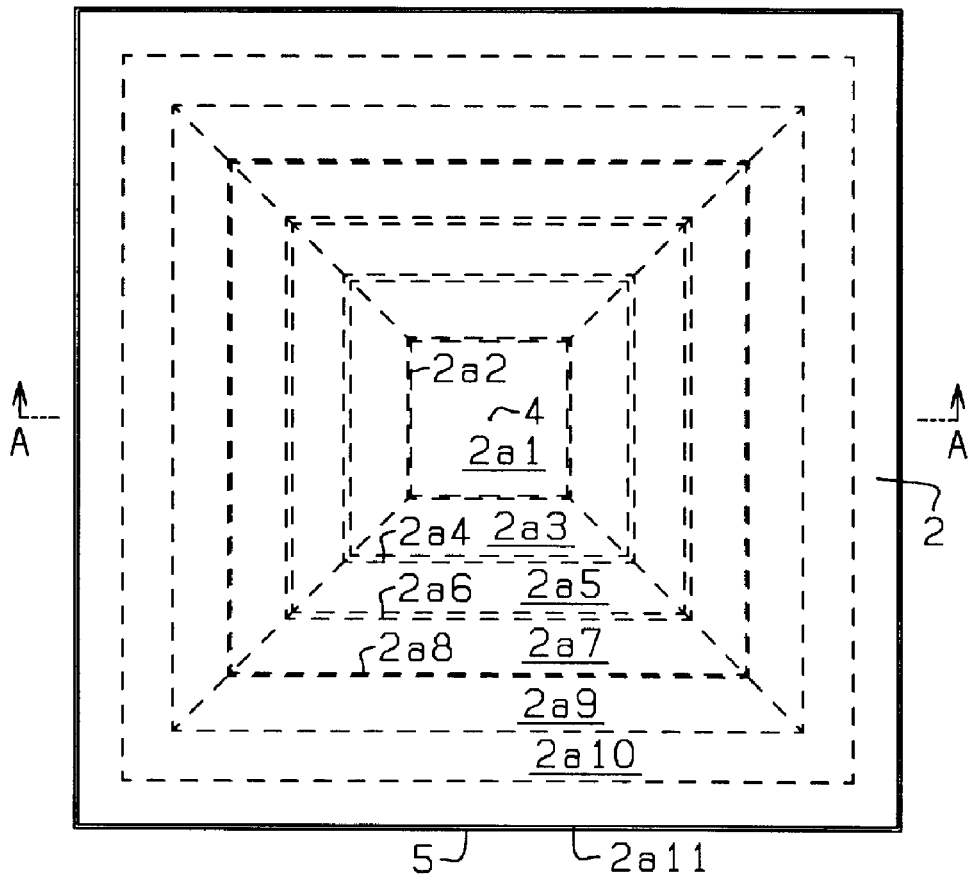
FIG. 2A is a front view of a lighting device made in accordance with principles of the presently disclosed subject matter as a first exemplary embodiment.
Figure 2B:
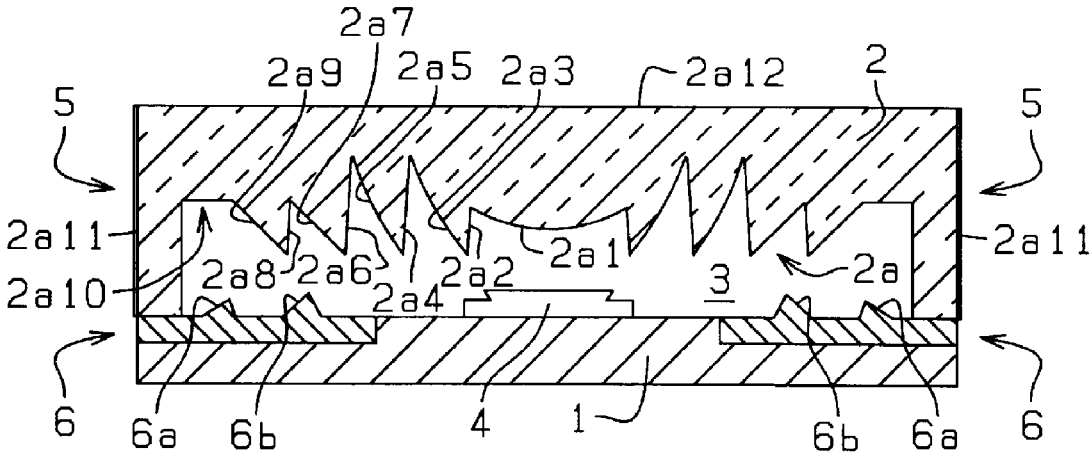
FIG. 2B is a cross-sectional view taken along line A-A of FIG. 2A.

A description will now be made below with respect to exemplary lighting devices made in accordance with principles of the presently disclosed subject matter with reference to the accompanying drawings. A first exemplary embodiment will be discussed hereinafter with reference to FIGS. 2A and 2B. FIG. 2A is a front view of a lighting device according to the first exemplary embodiment, and FIG. 2B is a cross-sectional view taken along line A-A of FIG. 2A. FIGS. 3A, 3B, and 3C and FIGS. 4A and 4B are diagrams each showing light paths in the cross section of FIG. 2B.

In the lighting device of the first exemplary embodiment, as shown in FIGS. 2A through 4B, a light source 4 such as an LED can be installed on a substrate 1. The substrate 1 can be made of a material having high heat conductivity and heat dissipation property such as aluminum, an aluminum alloy, and the like. A reflecting member 6 including reflecting portions 6*a* and 6*b* can be attached to the substrate 1. As shown in FIG. 2B, the reflecting member 6 can be disposed on the upper surface of the substrate 1 (upper side of the drawing). In the lighting device of the present exemplary embodiment, an LED is employed as the light source 4. However, the presently disclosed subject matter is not limited thereto, and any suitable light source other than LEDs can be employed. In the lighting device of the present exemplary embodiment, aluminum is employed as the material for the substrate 1. However, the presently disclosed subject matter is not limited thereto, and any suitable material other than aluminum can be employed as long as the material can have the same or similar properties as aluminum.

The lighting device of the present exemplary embodiment includes a lens 2. As shown in FIG. 2B, the lens 2 can be disposed above the substrate 1 and the reflecting member 6 (upper side of the drawing). As a result, a lighting chamber 3 can be defined by the substrate 1 and the lens 2 so that the light source 4 is disposed within the lighting chamber 3.

In the lighting device of the present exemplary embodiment, as shown in FIG. 2B, a lens cut portion 2*a* is formed in the lower surface, or rear surface, of the lens 2 (lower side of the drawing).

In the lighting device of the exemplary embodiment configured as described above, and as shown in FIG. 3A, the lens cut portion 2*a* of the lens 2 is provided with a transmission surface 2*a*1 configured to allow light beams L1 and L2 emitted from the light source 4 to pass therethrough.

Specifically, light beams L1 emitted from the light source 4 along the main optical axis L of the light source 4 can pass through the transmission surface 2*a*1 of the lens cut portion 2*a* of the lens 2, and then can pass through a front surface 2*a*12 of the lens 2 to be projected in the illumination direction of the lighting device.

The light beams L2 emitted from the light source 4 at a small angle with respect to the main optical axis L of the light source 4 can pass through the transmission surface 2*a*1 of the lens cut portion 2*a* of the lens 2, and then can be refracted thereby and pass through the front surface 2*a*12 of the lens 2 to be projected in the illumination direction of the lighting device.

Figure 3A:
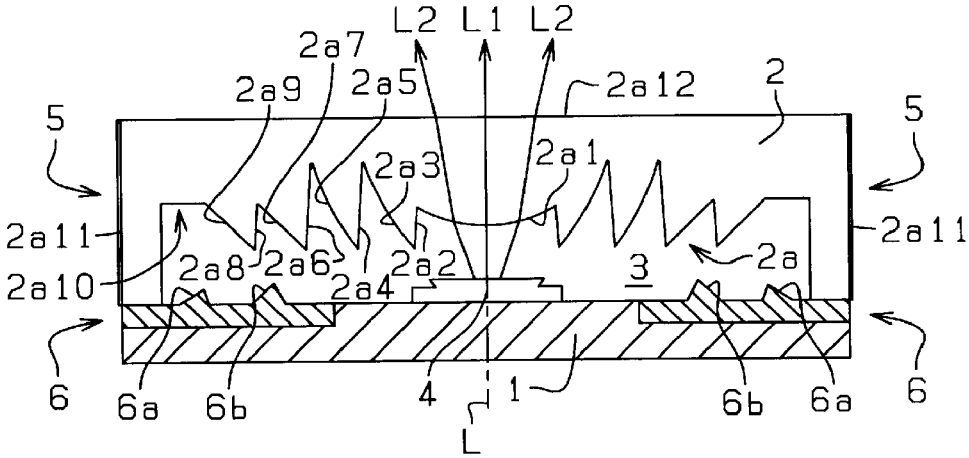
FIGS. 3A, 3B, and 3C are diagrams each showing light paths in the cross section of FIG. 2B.
Figure 3B:
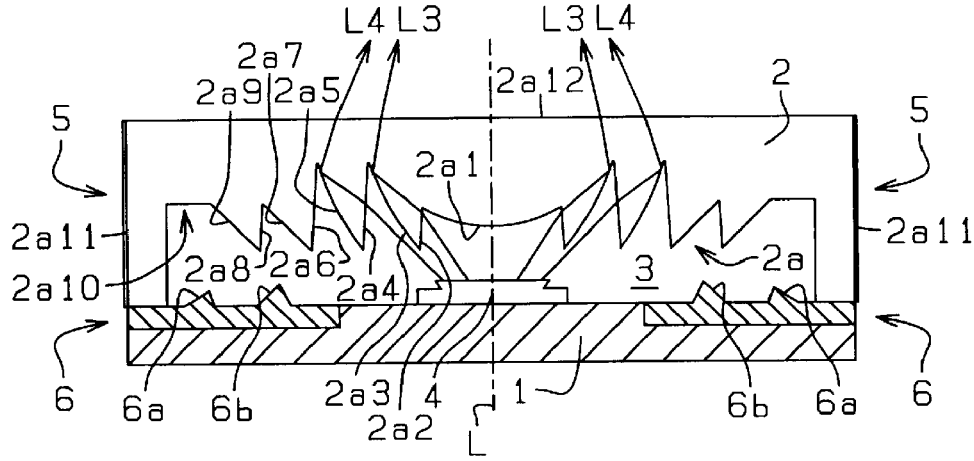

As shown in FIG. 3B, the lens cut portion 2*a* of the lens 2 is also provided with a transmission surface 2*a*2 configured to allow light beams L3 emitted from the light source 4 to pass therethrough, and a reflection surface 2*a*3 configured to reflect the light beams L3 having passed through the transmission surface 2*a*2.

Specifically, the light beams L3 emitted from the light source 4 at a larger angle than that of the light beams L2 with respect to the main optical axis L of the light source 4 can pass through the transmission surface 2*a*2 of the lens cut portion 2*a* of the lens 2, and then can be reflected by the reflection surface 2*a*3 and pass through the front surface 2*a*12 of the lens 2 to be projected in the illumination direction of the lighting device.

As shown in FIG. 3B, the lens cut portion 2*a* of the lens 2 is also provided with a transmission surface 2*a*4 configured to allow light beams L4 emitted from the light source 4 to pass therethrough, and a reflection surface 2*a*5 configured to reflect the light beams L4 having passed through the transmission surface 2*a*4.

Specifically, the light beams L4 emitted from the light source 4 at a larger angle than that of the light beams L3 with respect to the main optical axis L of the light source 4 can pass through the transmission surface 2*a*4 of the lens cut portion 2*a* of the lens 2, and then can be reflected by the reflection surface 2*a*5 and pass through the front surface 2*a*12 of the lens 2 to be projected in the illumination direction of the lighting device.

Figure 3C:
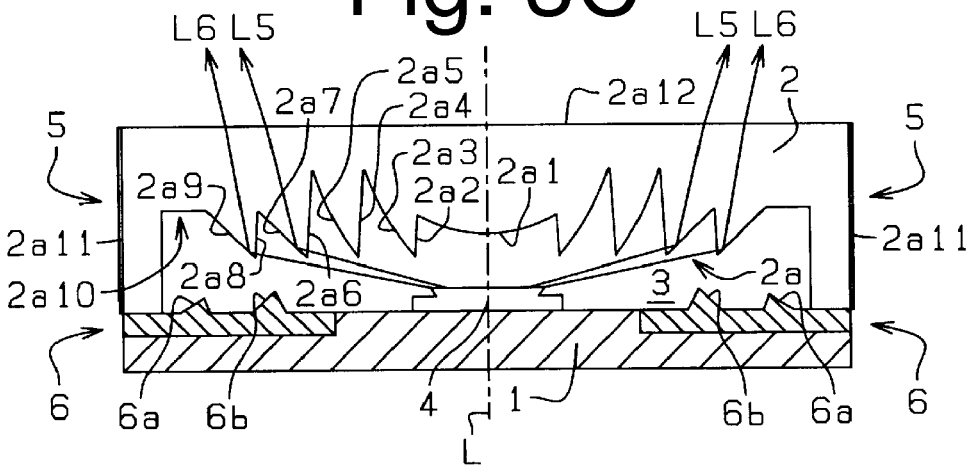

As shown in FIG. 3C, the lens cut portion 2*a* of the lens 2 is further provided with a transmission surface 2*a*6 configured to allow light beams L5 emitted from the light source 4 to pass therethrough, and a reflection surface 2*a*7 configured to reflect the light beams L5 having passed through the transmission surface 2*a*6.

Specifically, the light beams L5 emitted from the light source 4 at a larger angle than that of the light beams L4 with respect to the main optical axis L of the light source 4 can pass through the transmission surface 2*a*6 of the lens cut portion 2*a* of the lens 2, and then can be reflected by the reflection surface 2*a*7 and pass through the front surface 2*a*12 of the lens 2 to be projected in the illumination direction of the lighting device.

Furthermore, as shown in FIG. 3C, the lens cut portion 2*a* of the lens 2 is also provided with a transmission surface 2*a*8 configured to allow light beams L6 emitted from the light source 4 to pass therethrough, and a reflection surface 2*a*9 configured to reflect the light beams L6 having passed through the transmission surface 2*a*8.

Specifically, the light beams L6 emitted from the light source 4 at a larger angle than that of the light beams L5 with respect to the main optical axis L of the light source 4 can pass through the transmission surface 2*a*8 of the lens cut portion 2*a* of the lens 2, and then can be reflected by the reflection surface 2*a*9 and pass through the front surface 2*a*12 of the lens 2 to be projected in the illumination direction of the lighting device.

In the lighting device of the first exemplary embodiment, as shown in the drawings, the lens 2 can have an outer peripheral surface 2*a*11 that is subjected to a reflection treatment including a brightness treatment such as aluminum vapor deposition or the like to form a reflecting film 5 thereon (reflection surface).

Figure 4A:
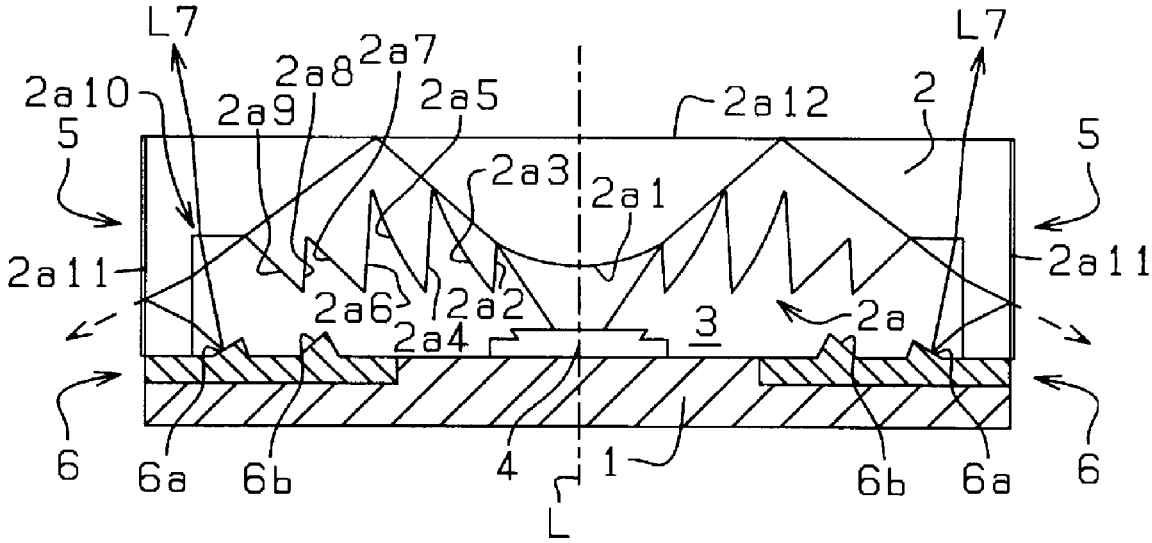
FIGS. 4A and 4B are diagrams each showing other light paths in the cross section of FIG. 2B.

In particular, as shown in FIG. 4A, light beams L7 emitted from the light source 4 at a larger angle than that of the light beam L2 with respect to the main optical axis L of the light source 4 can pass through the transmission surface 2*a*2 of the lens cut portion 2*a* of the lens 2. Then the light beams L7 cannot be reflected by the reflection surface 2*a*3 of the lens cut portion 2*a* of the lens 2, but can be reflected by the front surface 2*a*12 of the lens 2. Then, the light beams L7 does not pass through the outer peripheral surface 2*a*11 of the lens 2 as shown by a dotted line in FIG. 4A, but can be reflected by the reflection surface of the outer peripheral surface 2*a*11 of the lens 2. Subsequently, the light beams L7 can be incident on the reflecting portion 6*a* of the reflecting member 6 to be reflected thereby. The reflected light beams L7 can pass through the transmission area 2*a*10 disposed between the lens cut portion 2*a* of the lens 2 and the outer peripheral surface 2*a*11. As a result, the light beams L7 can pass through the front surface 2*a*12 of the lens 2 to be projected in the illumination direction of the lighting device.

Figure 4B:
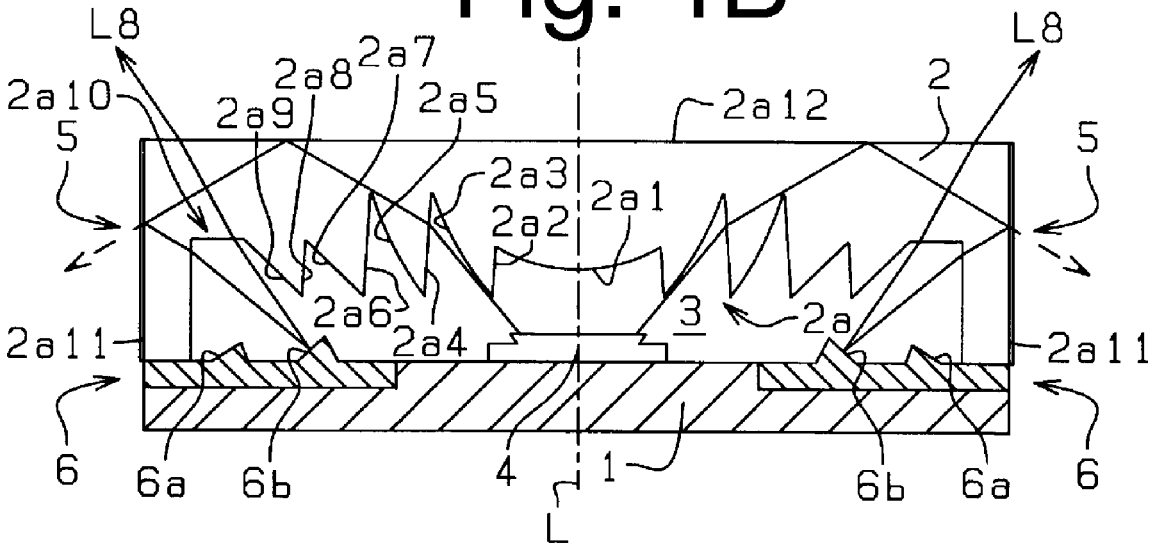

Furthermore, as shown in FIG. 4B, light beams L8 emitted from the light source 4 at a larger angle than that of the light beam L7 with respect to the main optical axis L of the light source 4 can pass through the transmission surface 2*a*4 of the lens cut portion 2*a* of the lens 2. Then the light beams L8 cannot be reflected by the reflection surface 2*a*5 of the lens cut portion 2*a* of the lens 2, but can be reflected by the front surface 2*a*12 of the lens 2. Then, the light beams L8 does not pass through the outer peripheral surface 2*a*11 of the lens 2 as shown by a dotted line in FIG. 4B, but can be reflected by the reflection surface of the outer peripheral surface 2*a*11 of the lens 2. Subsequently, the light beams L8 can be incident on the reflecting portion 6*b* of the reflecting member 6 to be reflected thereby. The reflected light beams L8 can pass through the transmission area 2*a*10 disposed between the lens cut portion 2*a* of the lens 2 and the outer peripheral surface 2*a*11. As a result, the light beams L8 can pass through the front surface 2*a*12 of the lens 2 to be projected in the illumination direction of the lighting device.

Accordingly, as shown in FIG. 4A by the dotted line, if the lamp were configured as a conventional system, the light beams L7 emitted from the light source 4 at a certain angle with respect to the main optical axis L of the light source 4, that are not reflected by the reflection surface 2*a*3 of the lens cut portion 2*a*, but reflected by the front surface 2*a*12 of the lens 2 would pass through the outer peripheral surface 2*a*11 of the lens 2. Accordingly, the light beams L7 would be projected out of the illumination direction of the lighting device (lower side in FIG. 4A, for example). However, the embodiment of the lighting device shown in FIG. 4A-B can prevent the light beams L7 from being projected in such a direction, thereby improving the light utilization efficiency as well as preventing the occurrence of glare light.

Furthermore, as shown in FIG. 4B by the dotted line, if the lamp were configured as a conventional system, the light beams L8 emitted from the light source 4 at a certain angle with respect to the main optical axis L of the light source 4, that are not reflected by the reflection surface 2*a*5 of the lens cut portion 2*a*, but reflected by the front surface 2*a*12 of the lens 2 would pass through the outer peripheral surface 2*a*11 of the lens 2. Accordingly, the light beams L8 would be projected out of the illumination direction of the lighting device (lower side in FIG. 4B). However, the embodiment of the lighting device shown in FIG. 4A-B can prevent the light beams L8 from being projected in such a direction, thereby improving the light utilization efficiency as well as preventing the occurrence of glare light.

The thus configured lighting device, when applied to a roadway illumination assembly or an outdoor illumination assembly, can prevent light beams emitted from the light source from becoming glare light when the light beams are projected out of the projection area in the illumination direction of the lighting device.

A description will now be given of a second exemplary embodiment of a lighting device made in accordance with principles of the presently disclosed subject matter. The lighting device of the second exemplary embodiment is configured in the same manner as the lighting device of the first exemplary embodiment except for the following points. Accordingly, the lighting device of the second exemplary embodiment can provide the same or similar advantageous effects as those of the lighting device of the first exemplary embodiment except possibly with respect to the following points.

Figure 5:
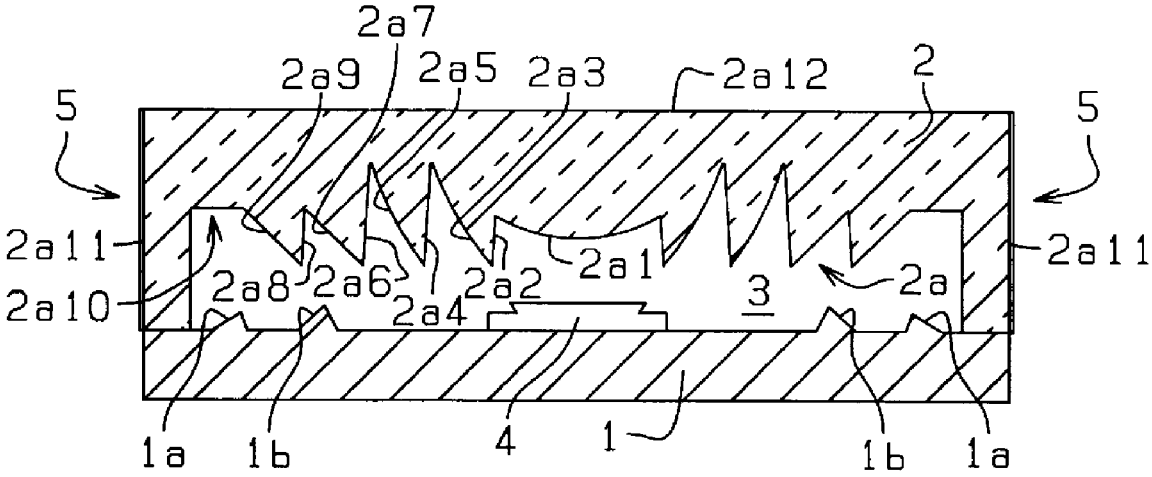
FIG. 5 is a cross-sectional view illustrating a lighting device according to a second exemplary embodiment.

FIG. 5 shows a lighting device according to the second exemplary embodiment. Specifically, FIG. 5 is almost the same cross-sectional view of the lighting device according to the second exemplary embodiment as that shown in FIG. 2B. In the lighting device of the first exemplary embodiment, as shown in FIG. 2B, the substrate 1 and the reflecting member 6 which include the reflecting portions 6*a* and 6*b* are formed as separate members. In the lighting device of the second exemplary embodiment, as shown in FIG. 5, the substrate 1 can be formed of a reflective material such as aluminum, thereby forming the reflecting portions 1*a* and 1*b* directly by the substrate 1. In other words, the substrate can function as the reflecting member or the reflecting portions 1*a* and 1*b*. More specifically, the reflecting member substrate 1 and the reflecting portions 1*a* and 1*b* are made of a single, unitary, continuous, and substantially homogenous material. In the lighting device of the second exemplary embodiment, the entire assembly cost can thus be suppressed when compared with the case where the substrate 1 and the reflecting member are separately provided.

A description will now be given of a third exemplary embodiment of a lighting device made in accordance with principles of the presently disclosed subject matter. The lighting device of the third exemplary embodiment can be configured in the same manner as the lighting device of the first exemplary embodiment except for the following points. Accordingly, the lighting device of the third exemplary embodiment can provide the same or similar advantageous effects as those of the lighting device of the first exemplary embodiment except possibly for the following points.

Figure 6A:
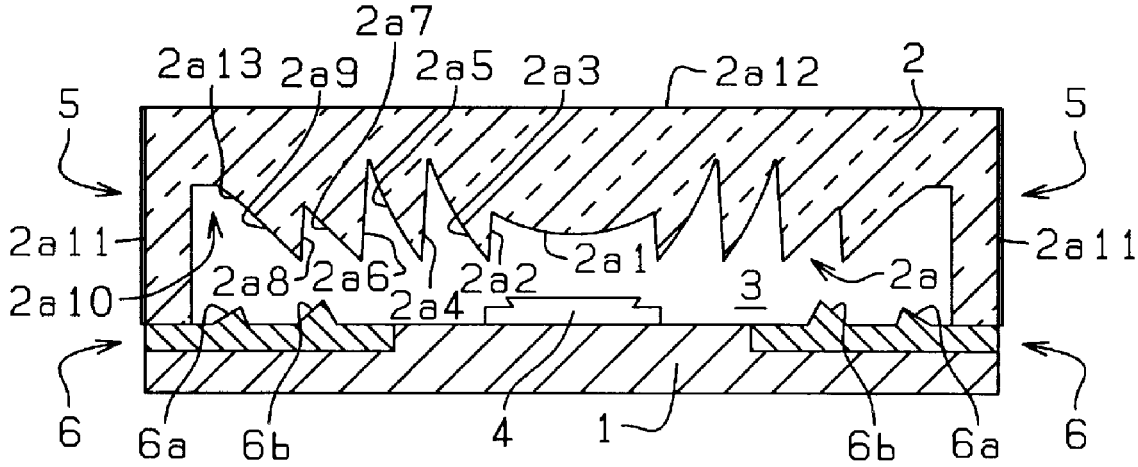
FIGS. 6A and 6B are cross-sectional views illustrating light paths in a lighting device according to a third exemplary embodiment.
Figure 6B:
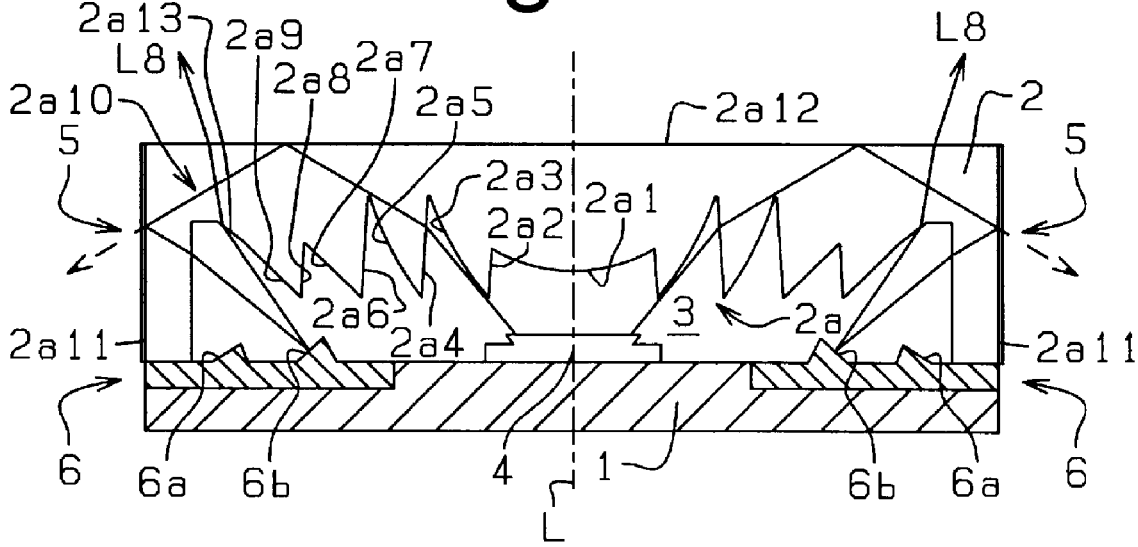

FIGS. 6A and 6B show the lighting device of the third exemplary embodiment. Specifically, FIG. 6A is almost the same cross-sectional view of the lighting device according to the third exemplary embodiment as that shown in FIG. 2B. FIG. 6B shows the light paths of the light beam L8 emitted from the light source 4 in the same manner as in FIG. 4B.

In the lighting device of the first exemplary embodiment, as shown in FIG. 2B, the transmission area 2*a*10 between the lens cut portion 2*a* and the outer peripheral surface 2*a*11 of the lens 2 is composed of a flat surface. On the contrary, the lighting device of the third exemplary embodiment can have another lens cut portion (second lens cut portion) 2*a*13 formed in the transmission area 2*a*10 between the lens cut portion (first lens cut portion) 2*a* and the outer peripheral surface 2*a*11 of the lens 2 as shown in FIG. 6A.

Specifically, in the lighting device of the first exemplary embodiment, the light beams L8 that are emitted from the light source 4 at a certain angle with respect to the main optical axis L of the light source 4 and pass through the transmission area 2*a*10 of the lens 2 can be projected in the illumination direction at a relatively large angle with respect to the main optical axis L of the light source 4. On the contrary, since the lighting device of the third exemplary embodiment has the second lens cut portion 2*a*13 formed in the transmission area 2*a*10 of the lens 2, the light beams L8 that are emitted from the light source 4 at the certain angle with respect to the main optical axis L of the light source 4 and pass through the second lens cut portion 2*a*13 in the transmission area 2*a*10 of the lens 2 can be projected in the illumination direction at a relatively small angle with respect to the main optical axis L of the light source 4. This can improve the light distribution property in the illumination direction.

Note that the lighting devices of the present exemplary embodiments described above are configured to take a square shape when viewed from its front as shown in FIG. 2A. The presently disclosed subject matter, however, is not limited thereto and the lighting device can take any shape when viewed from front, such as a circular shape, an elliptic shape, any polygonal shape, or the like.

The above described exemplary embodiments and modifications can be combined with each other in accordance with the intended applications.

The lighting devices of the presently disclosed subject matter can be applied to a roadway illumination assembly, an outdoor illumination assembly, and the like.

It will be apparent to those skilled in the art that various modifications and variations can be made in the presently disclosed subject matter without departing from the spirit or scope of the invention. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting device configured to emit light in an illumination direction comprising:

a substrate;

a lens opposed to the substrate, the lens having an outer peripheral surface and being provided with a first lens cut portion formed on a rear surface of the lens with respect to the illumination direction of the lighting device such that the first lens cut portion faces the substrate, the substrate and the lens defining a lighting chamber there between;

a light source disposed within the lighting chamber and having a main optical axis substantially aligned with the illumination direction, the light source configured to emit light beams at certain angles with respect to the main optical axis, a first portion of the light beams being reflected by the first lens cut portion and projected in the illumination direction; and a reflecting portion configured to reflect at least a portion of the light beams, the reflecting portion located at a front side of the substrate with respect to the illumination direction, wherein the lens includes a reflection surface configured to reflect light beams that are emitted from the light source and which travel within the lens and enter the outer peripheral surface of the lens, the reflection surface being located substantially at the outer peripheral surface of the lens, and the reflecting portion configured to reflect light beams reflected by the reflection surface.

2. The lighting device according to claim 1, wherein the reflection surface is formed by subjecting the outer peripheral surface of the lens to a reflection treatment including a brightness treatment.

3. The lighting device according to claim 1, wherein the lens includes a transmission area located between the first lens cut portion and the outer peripheral surface of the lens, the transmission area being configured to allow light beams reflected by the reflecting portion to pass therethrough so as to be projected in the illumination direction.

4. The lighting device according to claim 2, wherein the lens includes a transmission area located between the first lens cut portion and the outer peripheral surface of the lens, the transmission area being configured to allow light beams reflected by the reflecting portion to pass therethrough so as to be projected in the illumination direction.

5. The lighting device according to claim 3, wherein the lens includes a second lens cut portion located in the transmission area, the second lens cut portion being configured for controlling a light distribution property of light beams passing through the transmission area.

6. The lighting device according to claim 4, wherein the lens includes a second lens cut portion located in the transmission area, the second lens cut portion being configured for controlling a light distribution property of light beams passing through the transmission area.

7. The lighting device according to claim 1, wherein the substrate is formed of a reflective material and the reflecting portion is an integral portion of the substrate.

8. The lighting device according to claim 2, wherein the substrate is formed of a reflective material and the reflecting portion is an integral portion of the substrate.

9. The lighting device according to claim 3, wherein the substrate is formed of a reflective material and the reflecting portion is an integral portion of the substrate.

10. The lighting device according to claim 4, wherein the substrate is formed of a reflective material and the reflecting portion is an integral portion of the substrate.

11. The lighting device according to claim 5, wherein the substrate is formed of a reflective material and the reflecting portion is an integral portion of the substrate.

12. The lighting device according to claim 6, wherein the substrate is formed of a reflective material and the reflecting portion is an integral portion of the substrate.

13. The lighting device according to claim 1, further comprising:

a secondary reflecting portion located at the front of the substrate, the secondary reflecting portion including a secondary surface extending in a secondary direction, and the reflecting portion includes a surface extending in a first direction that is non-parallel with the secondary direction, both the first direction and secondary direction are configured at an angle between zero and ninety degrees with respect to the optical axis.

14. A lighting device configured to emit light in an illumination direction and along an optical axis comprising:

a substrate including at least one reflecting portion surface extending at an angle between zero and ninety degrees with respect to the optical axis of the lighting device;

a light source located adjacent the substrate and configured to emit light in the illumination direction and along the optical axis; and a lens located in front of the light source such that it receives the light emitted from the light source, the lens including a convex transmission surface facing the light source and intersecting with the optical axis of the lighting device, the lens including a secondary transmission surface extending from the convex transmission surface at an angle between zero and ninety degrees with respect to the convex transmission surface, the lens also including a secondary reflection surface extending from the secondary transmission surface at an angle between zero and ninety degrees with respect to the secondary transmission surface, wherein the lens includes an outermost peripheral reflection surface that extends substantially parallel with the optical axis of the lighting device and includes a reflective coating.

15. The lighting device according to claim 14, wherein the outermost peripheral reflection surface extends between a front surface of the lens and the substrate to form a chamber between the lens and the substrate.

16. The lighting device according to claim 14, wherein the lens includes an outermost transmission area located between the outermost peripheral reflection surface and the at least one secondary reflection surface, and the outermost transmission area extends substantially perpendicular to the optical axis of the lighting device.

17. The lighting device according to claim 14, wherein the substrate is formed of an opaque reflective material and the reflecting portion is integrated with the substrate such that the substrate and reflecting portion are a single unitary homogeneous one piece structure.

18. The lighting device according to claim 14, wherein the lens includes a third transmission surface extending from the secondary reflection surface at an angle between zero and ninety degrees with respect to the secondary reflection surface, the lens also including a third reflection surface extending from the third transmission surface at an angle between zero and ninety degrees with respect to the third transmission surface.

19. The lighting device according to claim 14, wherein the lens includes a substantially flat front surface facing away from the substrate.

20. The lighting device according to claim 14, wherein the lens is disposed above the substrate.

21. The lighting device according to claim 20, wherein the outermost peripheral reflection surface of the lens is disposed radially outside the secondary transmission surface.

22. The lighting device according to claim 14, wherein the lens is disposed above the substrate and the reflecting portion, and the lens and the substrate define a lighting chamber within which the light source is disposed.

* * * * *